US011219314B2

(12) United States Patent
Zhang et al.

(10) Patent No.: US 11,219,314 B2
(45) Date of Patent: Jan. 11, 2022

(54) STRUCTURALLY IMPROVED MANUAL SOFA STRETCHING DEVICE

(71) Applicant: ZHEJIANG FEILI TECHNOLOGY CO. , LTD., Jiaxing (CN)

(72) Inventors: Xiaoming Zhang, Jiaxing (CN); Jianfeng Ke, Jiaxing (CN)

(73) Assignee: ZHEJIANG FEILI TECHNOLOGY CO., LTD., Jiaxing (CN)

( * ) Notice: Subject to any disclaimer, the term of this patent is extended or adjusted under 35 U.S.C. 154(b) by 0 days.

(21) Appl. No.: 17/285,490

(22) PCT Filed: Dec. 31, 2019

(86) PCT No.: PCT/CN2019/130498
§ 371 (c)(1),
(2) Date: Apr. 15, 2021

(87) PCT Pub. No.: WO2020/168832
PCT Pub. Date: Aug. 27, 2020

(65) Prior Publication Data

US 2021/0361070 A1 Nov. 25, 2021

(30) Foreign Application Priority Data

Feb. 18, 2019 (CN) ..... 201920207307.7

(51) Int. Cl.
*A47C 1/031* (2006.01)
*A47C 1/0355* (2013.01)
*A47C 17/04* (2006.01)

(52) U.S. Cl.
CPC ..... *A47C 1/0355* (2013.01); *A47C 17/04* (2013.01)

(58) Field of Classification Search
CPC .. A47C 1/0355; A47C 1/0352; A47C 1/03211
See application file for complete search history.

(56) References Cited

U.S. PATENT DOCUMENTS 5,588,710 A 12/1996 Wiecek
8,696,054 B2 * 4/2014 Crum ..... A47C 1/0352 297/85 M
10,897,995 B2 * 1/2021 Crum ..... A47C 1/0355
(Continued)

FOREIGN PATENT DOCUMENTS

CN 202014873 U 10/2011
CN 203538831 U 4/2014
(Continued)

*Primary Examiner* — Shin H Kim
(74) *Attorney, Agent, or Firm* — Bayramoglu Law Offices LLC

(57) ABSTRACT

A structurally improved manual sofa stretching device includes a base. A functional frame is arranged on the base. The functional frame includes a leg structure, a seat structure and a back structure. The leg structure is connected to the seat structure, and the seat structure is connected to the back structure. The seat structure includes a mounting side plate, and the mounting side plate is arranged on the base. The leg structure includes a third foot rod, a fourth foot rod, a first extension link rod, a second extension link rod, a third extension link rod, a fourth extension link rod, a first Z-shaped linkage rod, a second Z-shaped linkage rod, a first footrest, a second footrest and a small footrest.

9 Claims, 7 Drawing Sheets

(56) References Cited

U.S. PATENT DOCUMENTS

| | | | | |
|---|---|---|---|---|
| 11,140,988 | B2 * | 10/2021 | Murphy | A47C 1/0355 |
| 2014/0327282 | A1 * | 11/2014 | Crum | A47C 7/02<br>297/259.2 |
| 2021/0100364 | A1 * | 4/2021 | Murphy | A47C 1/022 |

FOREIGN PATENT DOCUMENTS

| | | | |
|---|---|---|---|
| CN | 107028405 | A | 8/2017 |
| CN | 108451232 | A | 8/2018 |
| CN | 109008403 | A | 12/2018 |
| CN | 209563817 | U | 11/2019 |

* cited by examiner

STRUCTURALLY IMPROVED MANUAL SOFA STRETCHING DEVICE

CROSS REFERENCE TO THE RELATED APPLICATIONS

This application is the national phase entry of International Application No. PCT/CN2019/130498, filed on Dec. 31, 2019, which is based upon and claims priority to Chinese Patent Application No. 201920207307.7, filed on Feb. 18, 2019, the entire contents of which are incorporated herein by reference.

TECHNICAL FIELD

The present invention belongs to the technical field of sofas, and more particularly, relates to a structurally improved manual sofa stretching device.

BACKGROUND

With the continuous improvement of productivity and the rapid rise of social and economic levels, people enjoy increasingly improved standards of living, and also pose higher and higher requirements for furniture. Furniture such as sofas, rocking chairs and seats are ubiquitous. Some sofas are equipped with mechanical stretching devices, which are generally divided into electrical and manual types.

Chinese patent No. CN108451232A (application number: 201810402439.5), for example, discloses a structurally improved mechanical stretching device. This patented mechanical stretching device includes a base and a functional frame arranged on the base. The functional frame includes a leg structure, a seat structure and a back structure. The leg structure is connected to the seat structure, and the seat structure is connected to the back structure. The leg structure includes a third foot rod, and the seat structure includes a mounting member. A drive mechanism is arranged on the base and is configured to fold and unfold the functional frame. The drive mechanism includes a linear push rod guide rail motor, a front fixed sleeve and a rear mounting sleeve. The linear push rod guide rail motor includes a motor head, a guide rail and a slider. The slider is movably connected to the guide rail, and the guide rail is connected to the motor head. The motor head is hinged to the middle of the front fixed sleeve through a first detachable structure. The end of the front fixed sleeve is connected to the third foot rod, and the end of the rear mounting sleeve is connected to the middle of the mounting member. The rear mounting sleeve is hinged to the slider through a second detachable structure.

Although it can be manufactured at a low cost, the patented mechanical stretching device uses a sliding slot structure, and the sliding slot is prone to wear after long-term use. As a result, the leg structure cannot be unfolded or folded smoothly, resulting in poor stability during use. It is, therefore, highly desirable to provide a structurally improved manual sofa stretching device.

SUMMARY

To solve the above-mentioned problems in the prior art, an objective of the present invention is to provide a structurally improved manual sofa stretching device, which has the advantage of good stability in use.

The objective of the present invention is achieved by the following technical solutions. A structurally improved manual sofa stretching device includes a base. A functional frame is arranged on the base. The functional frame includes a leg structure, a seat structure and a back structure. The leg structure is connected to the seat structure, and the seat structure is connected to the back structure. The seat structure includes a mounting side plate, and the mounting side plate is arranged on the base. The leg structure includes a third foot rod, a fourth foot rod, a first extension link rod, a second extension link rod, a third extension link rod, a fourth extension link rod, a first Z-shaped linkage rod, a second Z-shaped linkage rod, a first footrest, a second footrest and a small footrest. One end of the first extension link rod is rotatably connected to the middle of the second footrest. The other end of the first extension link rod is rotatably connected to one end of the fourth foot rod. The other end of the fourth foot rod is rotatably connected to one end of the mounting side plate. One end of the second extension link rod is rotatably connected to the other end of the first footrest. The other end of the second extension link rod is rotatably connected to one end of the third foot rod. The other end of the third foot rod is rotatably connected to one end of the mounting side plate. One end of the third extension link rod is rotatably connected to the other end of the fourth extension link rod. The other end of the third extension link rod is rotatably connected to the middle of the first extension link rod. One end of the fourth extension link rod is rotatably connected to the middle of the first footrest. One end of the first footrest is provided with a first mounting hole. One end of the first Z-shaped linkage rod is rotatably connected to one end of the second footrest. The other end of the first Z-shaped linkage rod is rotatably connected to the middle of the third extension link rod. The other end of the second footrest is provided with a second mounting hole. One end of the second Z-shaped linkage rod is rotatably connected to the middle of the third extension link rod. The other end of the second Z-shaped linkage rod is rotatably connected to one end of the small footrest. The middle of the small footrest is rotatably connected to the middle of the second extension link rod. The other end of the small footrest is provided with a third mounting hole. The middle of the second extension link rod is further provided with a protruding limit part, and the limit part abuts against the middle of the second Z-shaped linkage rod. The back structure includes a backrest member. The backrest member is rotatably connected to the other end of the mounting side plate. A limit assembly is arranged on the base, and is configured to limit the position of the backrest member.

In the present invention, it is necessary to frequently unfold or fold the leg structure when the sofa is switched between a sitting posture mode, a TV-watching posture mode and a lying posture mode. In this regard, instead of traditionally designing a sliding slot at the footrest of the leg structure, the link rods and linkage rods, which are not prone to wear after long-term use, are employed so that the leg structure can be unfolded or folded more smoothly, thereby greatly improving the service life and providing good stability during use.

Preferably, the seat structure further includes a front support member, a rear support member, a front linkage member, an intermediate linkage member, a rear linkage member, a first connecting rod, a second connecting rod, a third connecting rod and a fourth connecting rod. One end of the first connecting rod is rotatably connected to the backrest member. The other end of the first connecting rod is rotatably connected to one end of the intermediate linkage member. The other end of the intermediate linkage member is rotatably connected to one end of the rear support member. The other end of the rear support member is rotatably connected to the other end of the base. The middle of the intermediate linkage member is rotatably connected to one end of the third connecting rod. The other end of the third connecting rod is rotatably connected to the middle of the front linkage member. One end of the front linkage member is rotatably connected to one end of the front support member. The other end of the front support member is rotatably connected to one end of the base. The other end of the front linkage member is rotatably connected to the middle of the mounting side plate. The middle of the rear linkage member is rotatably connected to the middle of the mounting side plate. One end of the rear linkage member is rotatably connected to one end of the second connecting rod. The other end of the second connecting rod is rotatably connected to the middle of the front support member. The other end of the rear linkage member is rotatably connected to one end of the fourth connecting rod. The other end of the fourth connecting rod is rotatably connected to the middle of the fourth foot rod.

Preferably, the limit assembly includes a limit bushing. The other end of the mounting side plate is provided with a guide slot. The limit bushing is connected to the backrest member through a rotating shaft, and the limit bushing abuts against a side of the guide slot.

In this arrangement, when the TV-watching posture mode is switched to the lying posture mode, the limit bushing abuts against the side of the guide slot to effectively limit the position of the backrest member, instead of traditionally using connecting plates and limit columns to limit the position of the backrest member.

Preferably, the front linkage member is crescent-shaped, and the middle of the front linkage member is provided with a riveting hole and a spare hole.

In this arrangement, since the acting force of the backrest member becomes excessively small when the TV-watching posture mode is switched to the lying posture mode, the riveting hole of the front linkage member is adjusted to tighten the backrest member, while the original spare hole is reserved so that the riveting hole and the spare hole can be switched to each other to meet different needs of users.

Preferably, a first spring is further connected between the third connecting rod and the base through a first mounting assembly, and is configured to assist in unfolding the leg structure. The first mounting assembly includes a first spring peg and a second spring peg. The middle of the third connecting rod is provided with a first positioning hole. One end of the base is provided with a second positioning hole. One end of the first spring peg is inserted into the first positioning hole, and the other end of the first spring peg is connected to one end of the first spring. One end of the second spring peg is inserted into the second positioning hole, and the other end of the second spring peg is connected to the other end of the first spring.

In this arrangement, when the sitting posture mode is switched to the TV-watching posture mode, the elastic action of the first spring can assist in unfolding the leg structure.

Preferably, a second spring is further connected between the intermediate linkage member and the base through a second mounting assembly, and is configured to assist in retracting the back structure. The second mounting assembly includes a third spring peg. One end of the intermediate linkage member is provided with a third positioning hole. The middle of the mounting side plate is provided with a fourth positioning hole, and the fourth positioning hole is strip-shaped. One end of the third spring peg is inserted into the third positioning hole. The other end of the third spring peg is connected to one end of the second spring. The other end of the second spring is hooked in the fourth positioning hole.

In this arrangement, when the lying position mode is switched to the TV-watching posture mode, the elastic force of the second spring can assist in retracting the backrest member, thereby providing a 162° flat-lying mode, which has a satisfactory effect during use.

Preferably, the end of the guide slot is provided with an arc-shaped transition portion.

In this arrangement, the limit bushing can be smoothly engaged into the guide slot through the transition portion.

Preferably, the limit bushing is made of metal.

In this way, the service life of the limit bushing is greatly prolonged.

Preferably, the limit bushing is made of stainless steel.

Compared with the prior art, the improved manual stretching device for the sofa has the following advantages.

When the sofa is switched between the sitting posture mode, the TV-watching posture mode and the lying posture mode, it is necessary to frequently unfold or fold the leg structure. In this regard, instead of traditionally designing a sliding slot at the footrest of the leg structure, the link rods and linkage rods, which are not prone to wear after long-term use, are employed so that the leg structure can be unfolded or folded more smoothly, thereby greatly improving the service life and providing good stability during use.

In the figures: 1, base; 2, rear support member; 3, first connecting rod; 4, rotating shaft; 5, backrest member; 6, limit bushing; 7, third foot rod; 8, first extension link rod; 9, second extension link rod; 10, first Z-shaped linkage rod; 11, fourth foot rod; 12, mounting side plate; 12*a*, fourth positioning hole; 12*b*, guide slot; 13, front linkage member; 13*a*, riveting hole; 13*b*, spare hole; 14, front support member; 15, fourth connecting rod; 16, rear linkage member; 17, second spring; 18, intermediate linkage member; 19, third spring peg; 20, first spring peg; 21, third connecting rod; 22, second connecting rod; 23, first spring; 24, second spring peg; 25, small footrest; 26, second footrest; 27, first footrest; 28, fourth extension link rod; 29, third extension link rod; and 30, second Z-shaped linkage rod.

DETAILED DESCRIPTION OF THE EMBODIMENTS

Hereinafter, the technical solutions of the present invention will be further described with reference to the specific embodiments and drawings of the present invention, but the present invention is not limited to these embodiments.

Figure 1:
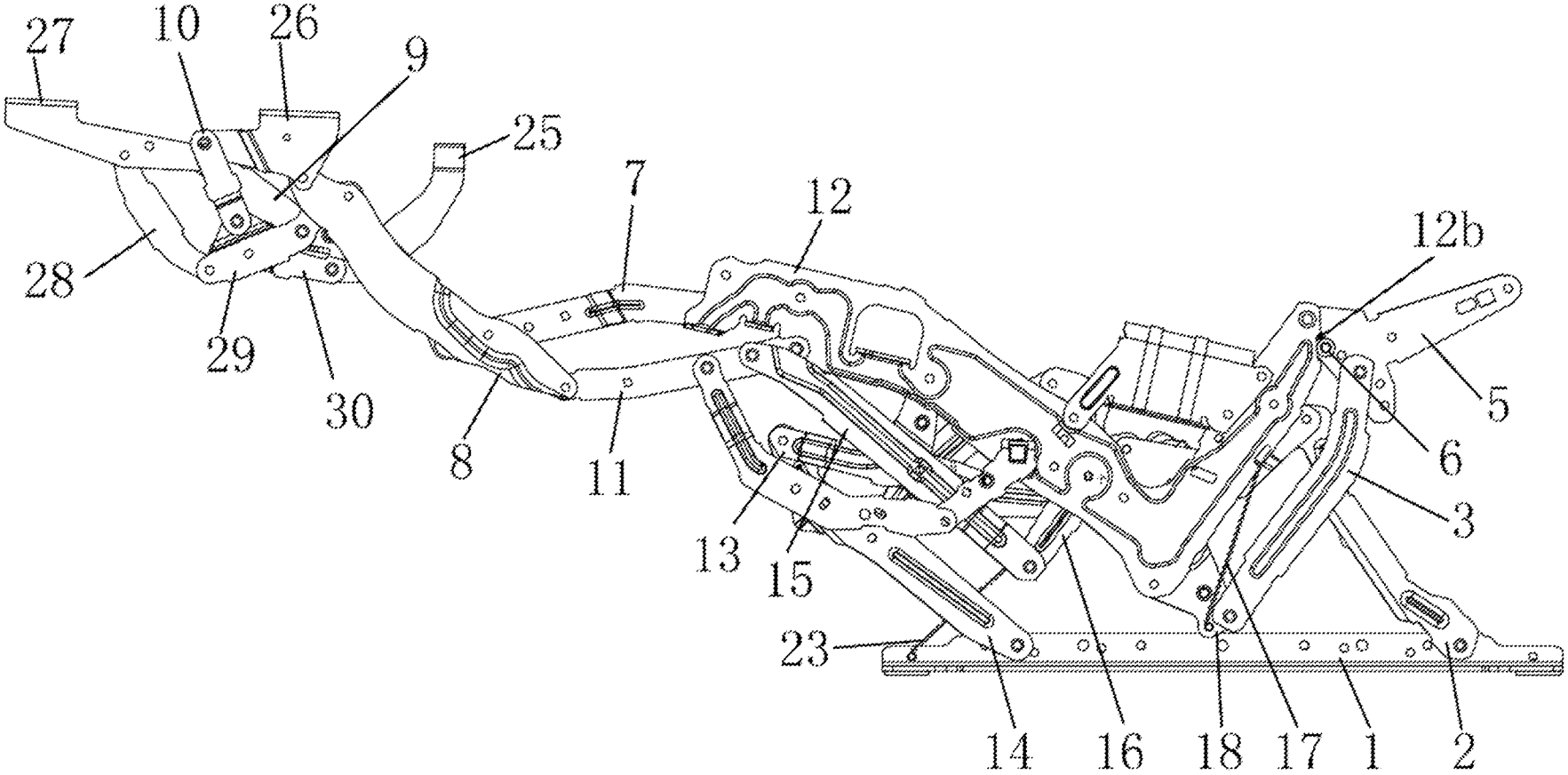
FIG. 1 is a schematic plan view of the present invention.
Figure 2:
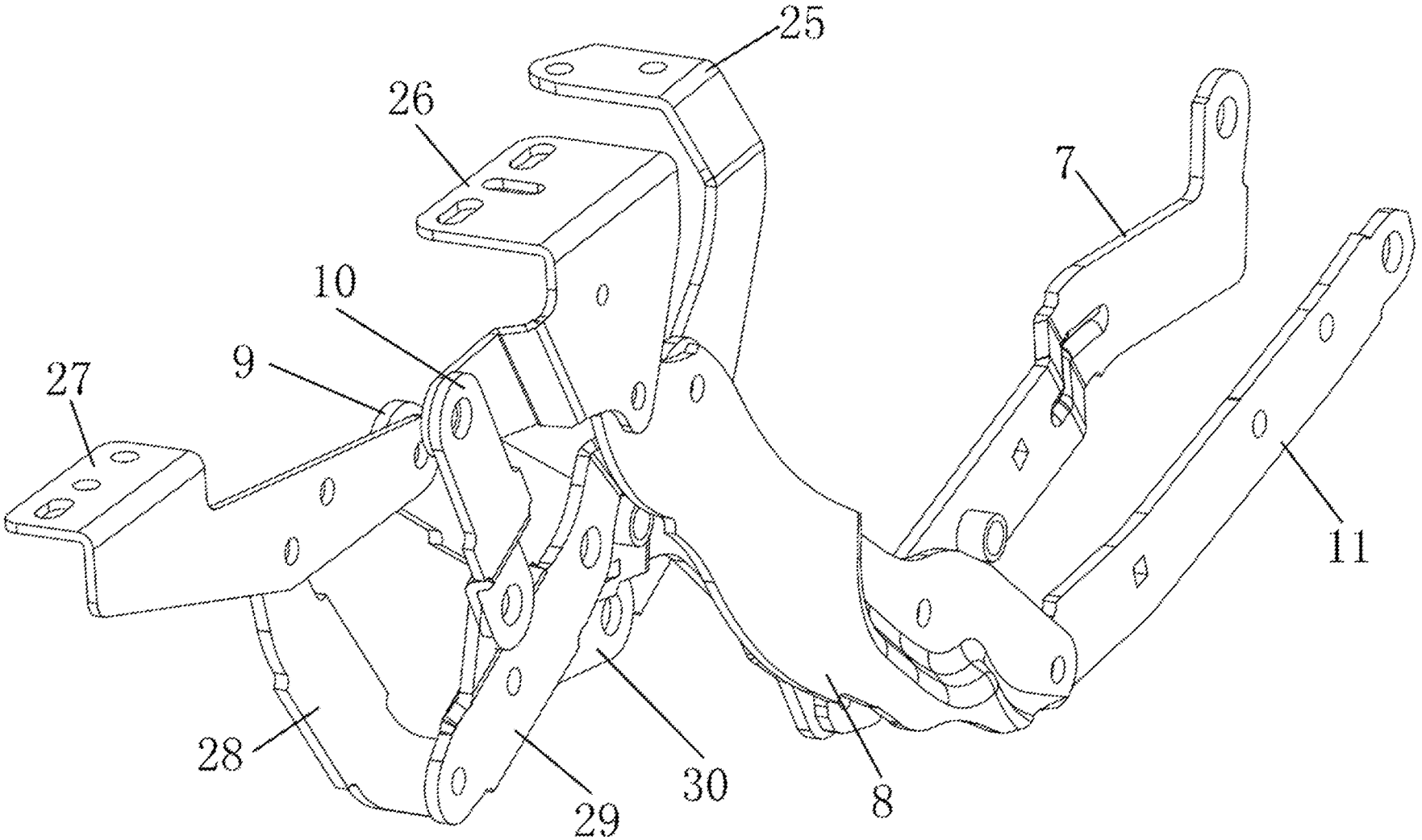
FIG. 2 is a schematic view of the three-dimensional structure of a leg structure of the present invention.
Figure 3:
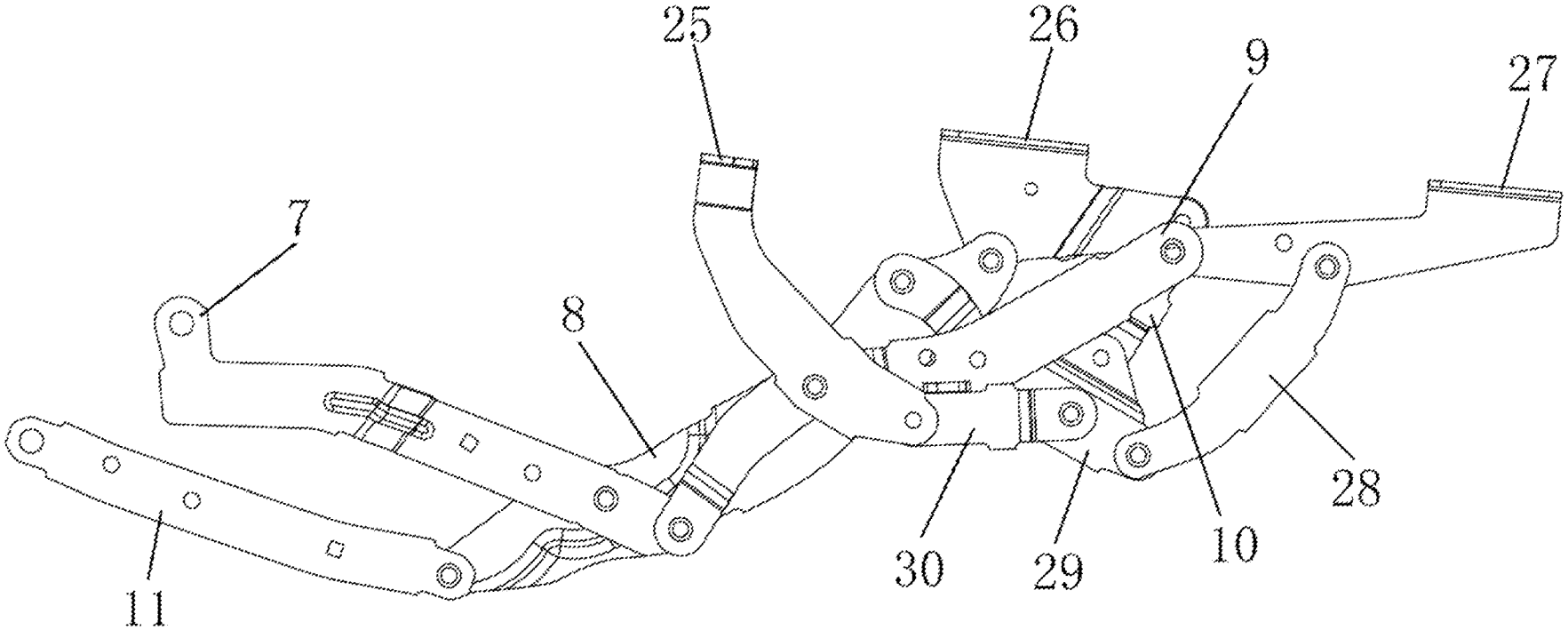
FIG. 3 is a schematic plan view of the leg structure of the present invention.
Figure 4:
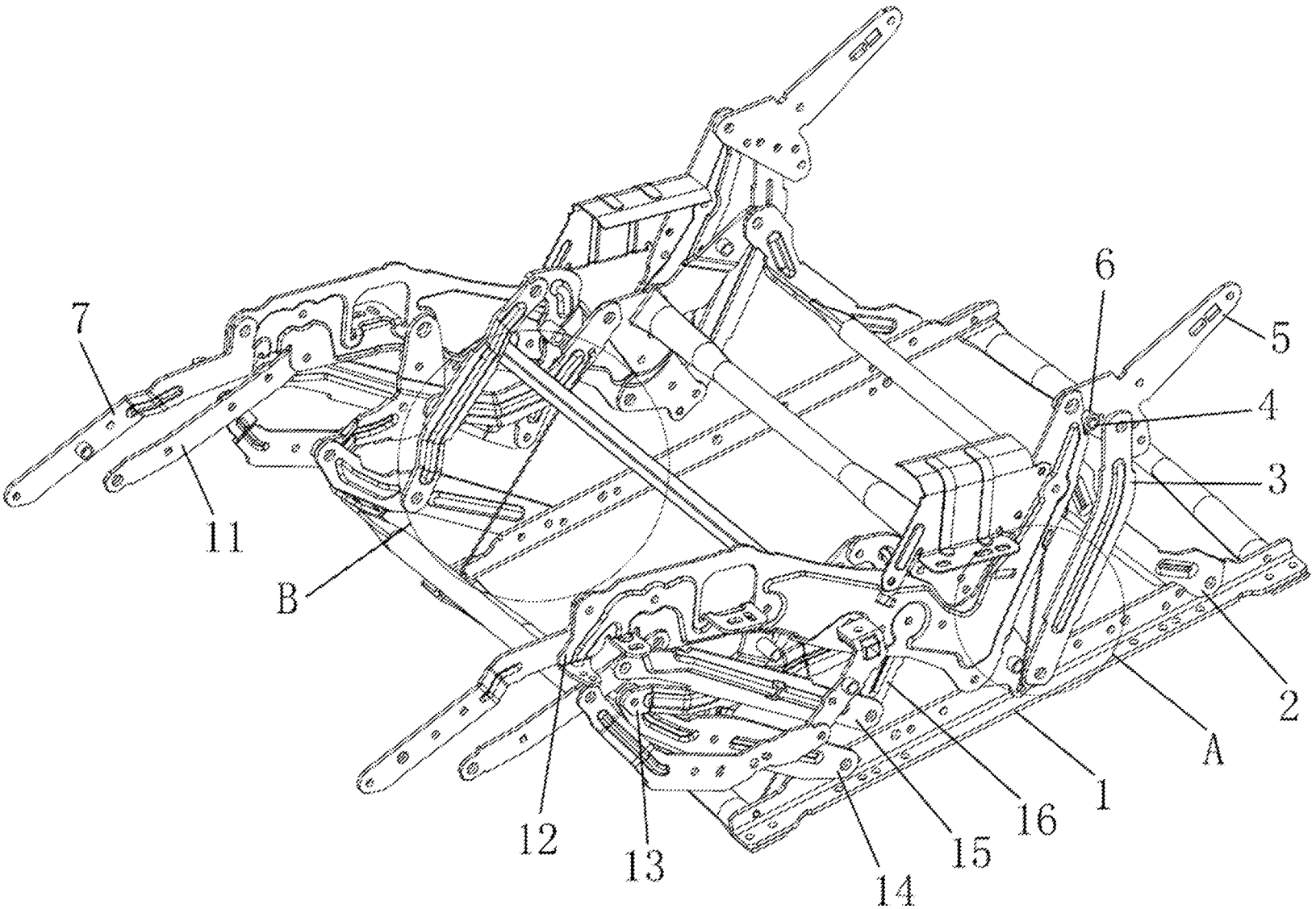
FIG. 4 is a schematic view of the three-dimensional structure of the present invention with a part of the leg structure removed.
Figure 5:
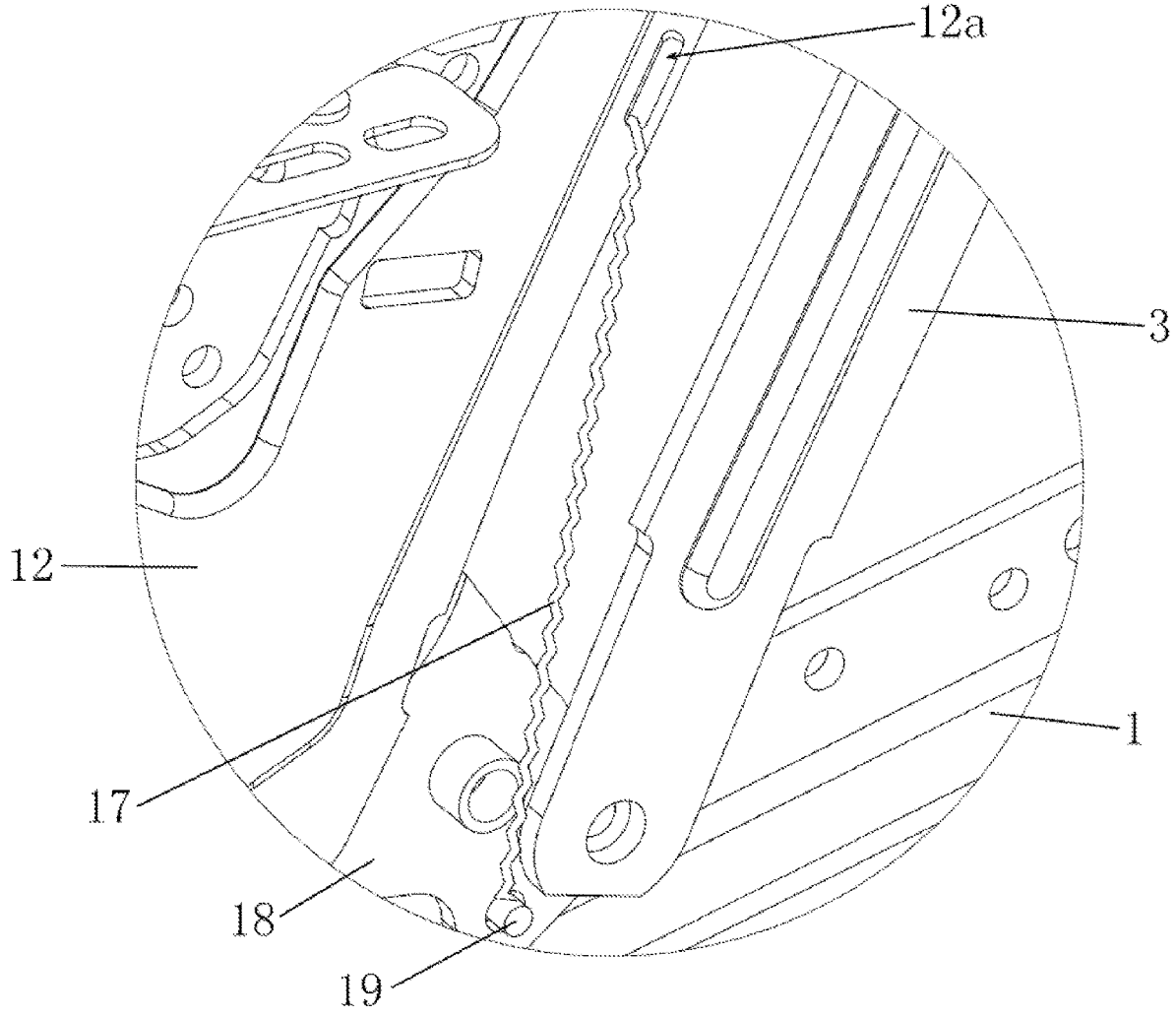
FIG. 5 is a partial enlarged view of the portion A encircled in FIG. 4.
Figure 6:
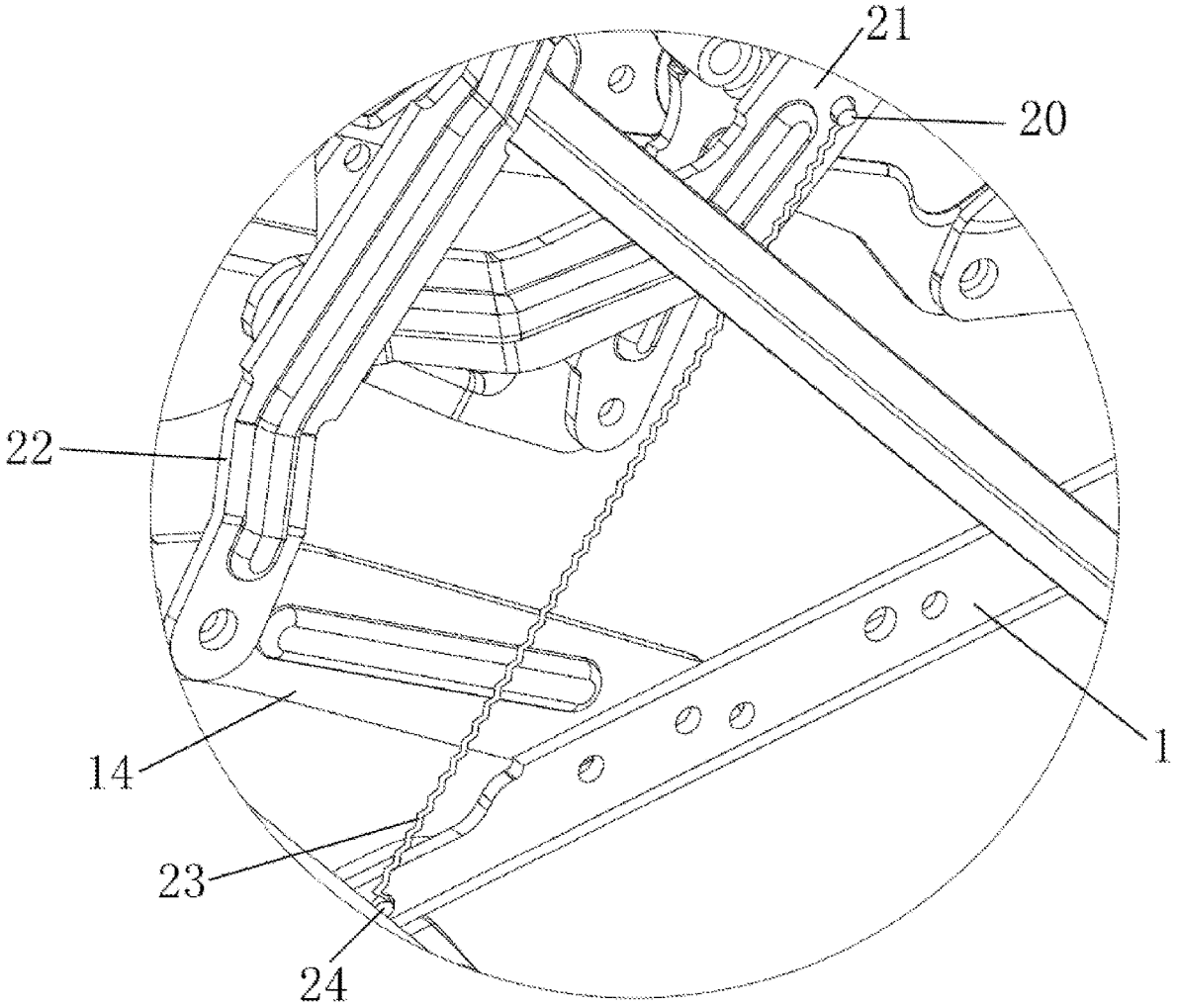
FIG. 6 is a partial enlarged view of the portion B encircled in FIG. 4.
Figure 7:
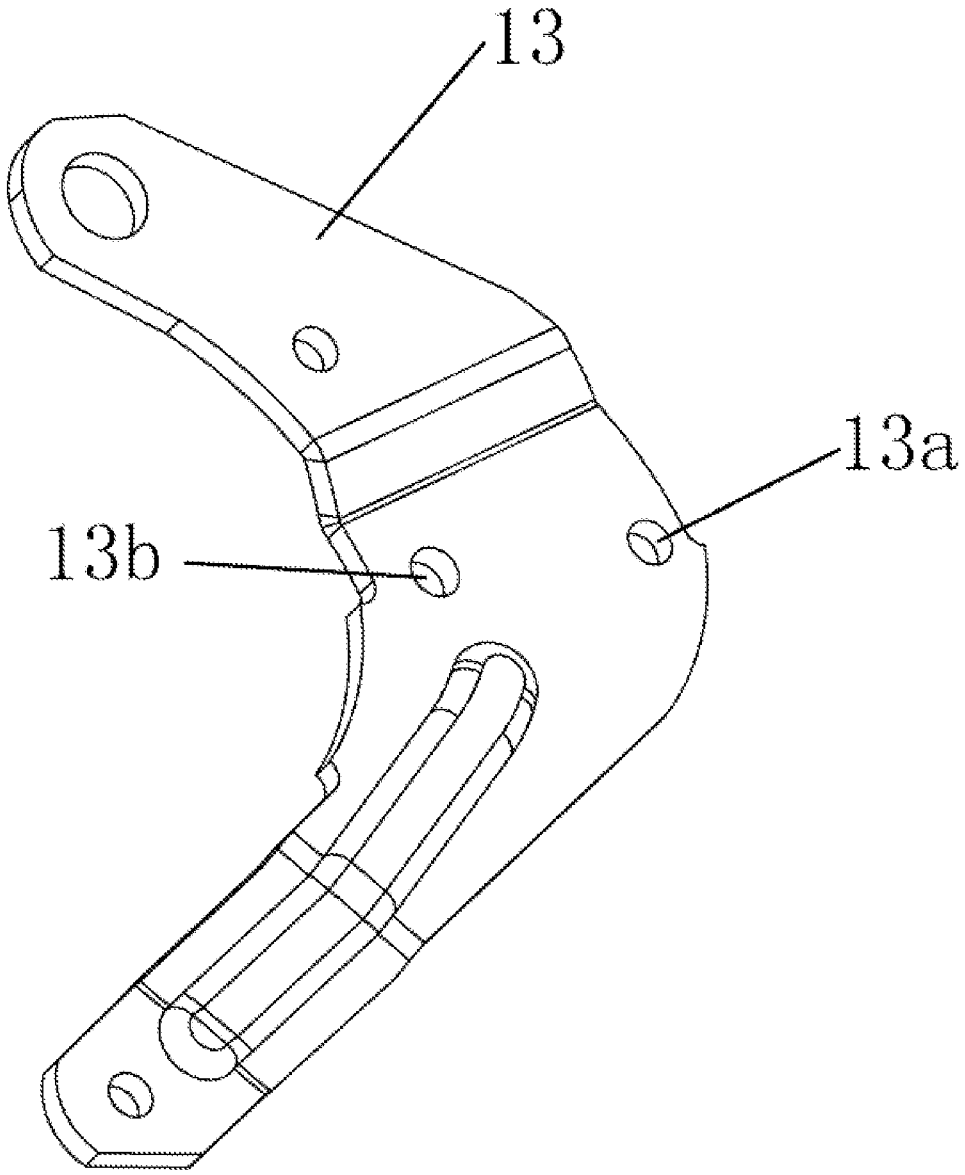
FIG. 7 is a schematic view of the three-dimensional structure of the front linkage member of the present invention.

As shown in FIGS. 1-7, a structurally improved manual sofa stretching device includes the base 1. A functional frame is arranged on the base 1. The functional frame includes a leg structure, a seat structure and a back structure. The leg structure is connected to the seat structure, and the seat structure is connected to the back structure. The seat structure includes the mounting side plate 12, and the mounting side plate 12 is arranged on the base 1. The leg structure includes the third foot rod 7, the fourth foot rod 11, the first extension link rod 8, the second extension link rod 9, the third extension link rod 29, the fourth extension link rod 28, the first Z-shaped linkage rod 10, the second Z-shaped linkage rod 30, the first footrest 27, the second footrest 26 and the small footrest 25. One end of the first extension link rod 8 is rotatably connected to the middle of the second footrest 26. The other end of the first extension link rod 8 is rotatably connected to one end of the fourth foot rod 11. The other end of the fourth foot rod 11 is rotatably connected to one end of the mounting side plate 12. One end of the second extension link rod 9 is rotatably connected to the other end of the first footrest 27. The other end of the second extension link rod 9 is rotatably connected to one end of the third foot rod 7. The other end of the third foot rod 7 is rotatably connected to one end of the mounting side plate 12. One end of the third extension link rod 29 is rotatably connected to the other end of the fourth extension link rod 28. The other end of the third extension link rod 29 is rotatably connected to the middle of the first extension link rod 8. One end of the fourth extension link rod 28 is rotatably connected to the middle of the first footrest 27. One end of the first footrest 27 is provided with a first mounting hole. One end of the first Z-shaped linkage rod 10 is rotatably connected to one end of the second footrest 26. The other end of the first Z-shaped linkage rod 10 is rotatably connected to the middle of the third extension link rod 29. The other end of the second footrest 26 is provided with a second mounting hole. One end of the second Z-shaped linkage rod 30 is rotatably connected to the middle of the third extension link rod 29. The other end of the second Z-shaped linkage rod 30 is rotatably connected to one end of the small footrest 25. The middle of the small footrest 25 is rotatably connected to the middle of the second extension link rod 9. The other end of the small footrest 25 is provided with a third mounting hole. The middle of the second extension link rod 9 is further provided with a protruding limit part, and the limit part abuts against the middle of the second Z-shaped linkage rod 30. In this arrangement, when the sofa is switched between the sitting posture mode, the TV-watching posture mode and the lying posture mode, it is necessary to frequently unfold or fold the leg structure. In this regard, instead of traditionally designing a sliding slot at the footrest of the leg structure, the link rods and linkage rods, which are not prone to wear after long-term use, are employed so that the leg structure can be unfolded or folded more smoothly, thereby greatly improving the service life and providing good stability during use.

The back structure includes the backrest member 5. The backrest member 5 is rotatably connected to the other end of the mounting side plate 12. The seat structure further includes the front support member 14, the rear support member 2, the front linkage member 13, the intermediate linkage member 18, the rear linkage member 16, the first connecting rod 3, the second connecting rod 22, the third connecting rod 21 and the fourth connecting rod 15. One end of the first connecting rod 3 is rotatably connected to the backrest member 5. The other end of the first connecting rod 3 is rotatably connected to one end of the intermediate linkage member 18. The other end of the intermediate linkage member 18 is rotatably connected to one end of the rear support member 2. The other end of the rear support member 2 is rotatably connected to the other end of the base 1. The middle of the intermediate linkage member 18 is rotatably connected to one end of the third connecting rod 21. The other end of the third connecting rod 21 is rotatably connected to the middle of the front linkage member 13. One end of the front linkage member 13 is rotatably connected to one end of the front support member 14. The other end of the front support member 14 is rotatably connected to one end of the base 1. The other end of the front linkage member 13 is rotatably connected to the middle of the mounting side plate 12. The middle of the rear linkage member 16 is rotatably connected to the middle of the mounting side plate 12. One end of the rear linkage member 16 is rotatably connected to one end of the second connecting rod 22. The other end of the second connecting rod 22 is rotatably connected to the middle of the front support member 14. The other end of the rear linkage member 16 is rotatably connected to one end of the fourth connecting rod 15. The other end of the fourth connecting rod 15 is rotatably connected to the middle of the fourth foot rod 11. A limit assembly is arranged on the base 1, and is configured to limit the position of the backrest member 5. The first spring 23 is further connected between the third connecting rod 21 and the base 1 through a first mounting assembly, and is configured to assist in unfolding the leg structure. The second spring 17 is further connected between the intermediate linkage member 18 and the base 1 through a second mounting assembly, and is configured to assist in retracting the back structure. In this arrangement, when the sitting posture mode is switched to the TV-watching posture mode, the elastic action of the first spring 23 can assist in unfolding the leg structure. When the lying position mode is switched to the TV-watching posture mode, the elastic force of the second spring 17 can assist in retracting the backrest member 5, thereby providing a 162° flat-lying mode, which has a satisfactory effect during use.

The front linkage member 13 is crescent-shaped, and the middle of the front linkage member 13 is provided with the riveting hole 13*a* and the spare hole 13*b*. In this arrangement, since the acting force of the backrest member becomes excessively small when the TV-watching posture mode is switched to the lying posture mode, the riveting hole 13*a* of the front linkage member 13 is adjusted to tighten the backrest member, while the original spare hole 13*b* is reserved so that the riveting hole 13*a* and the spare hole 13*b* can be switched to each other to meet different needs of users.

The limit assembly includes the limit bushing 6. The other end of the mounting side plate 12 is provided with the guide slot 12*b*. The limit bushing 6 is connected to the backrest member 5 through the rotating shaft 4, and the limit bushing 6 abuts against a side of the guide slot 12*b*. In this arrangement, when the TV-watching posture mode is switched to the lying posture mode, the limit bushing 6 abuts against the side of the guide slot 12*b* to effectively limit the position of the backrest member 5, instead of traditionally using connecting plates and limit columns to limit the position of the backrest member 5.

Further, the end of the guide slot 12*b* is provided with an arc-shaped transition portion. In this arrangement, the limit bushing 6 can be smoothly engaged into the guide slot 12*b* through the transition portion.

The limit bushing 6 is made of metal, so that the service life of the limit bushing 6 is greatly prolonged. Optionally, the limit bushing 6 may also be made of stainless steel according to actual needs.

The first mounting assembly includes the first spring peg 20 and the second spring peg 24. The middle of the third connecting rod 21 is provided with a first positioning hole. One end of the base 1 is provided with a second positioning hole. One end of the first spring peg 20 is inserted into the first positioning hole, and the other end of the first spring peg 20 is connected to one end of the first spring 23. One end of the second spring peg 24 is inserted into the second positioning hole, and the other end of the second spring peg 24 is connected to the other end of the first spring 23. The second mounting assembly includes the third spring peg 19. One end of the intermediate linkage member 18 is provided with a third positioning hole. The middle of the mounting side plate 12 is provided with the fourth positioning hole 12*a*, and the fourth positioning hole 12*a* is strip-shaped. One end of the third spring peg 19 is inserted into the third positioning hole. The other end of the third spring peg 19 is connected to one end of the second spring 17. The other end of the second spring 17 is hooked in the fourth positioning hole 12*a*.

In the present embodiment, each rotatable connection is realized by a rivet connection in the prior art.

The specific embodiments described herein are merely exemplified to illustrate the spirit of the present invention. Those skilled in the art can make various modifications or supplements to the specific embodiments described in the present invention or make substitutions to the present invention in a similar way without deviating from the spirit of the present invention, and these modifications, supplements and substitutions shall fall within the scope defined by the appended claims.

What is claimed is:

1. A structurally improved manual sofa stretching device, comprising a base;

wherein a functional frame is arranged on the base;

the functional frame comprises a leg structure, a seat structure and a back structure;

the leg structure is connected to the seat structure, and the seat structure is connected to the back structure;

the seat structure comprises a mounting side plate, and the mounting side plate is arranged on the base;

the leg structure comprises a third foot rod, a fourth foot rod, a first extension link rod, a second extension link rod, a third extension link rod, a fourth extension link rod, a first Z-shaped linkage rod, a second Z-shaped linkage rod, a first footrest, a second footrest and a small footrest;

a first end of the first extension link rod is rotatably connected to a middle of the second footrest;

a second end of the first extension link rod is rotatably connected to a first end of the fourth foot rod;

a second end of the fourth foot rod is rotatably connected to a first end of the mounting side plate;

a first end of the second extension link rod is rotatably connected to a second end of the first footrest;

a second end of the second extension link rod is rotatably connected to a first end of the third foot rod;

a second end of the third foot rod is rotatably connected to the first end of the mounting side plate;

a first end of the third extension link rod is rotatably connected to a second end of the fourth extension link rod;

a second end of the third extension link rod is rotatably connected to a middle of the first extension link rod;

a first end of the fourth extension link rod is rotatably connected to a middle of the first footrest;

a first end of the first footrest is provided with a first mounting hole;

a first end of the first Z-shaped linkage rod is rotatably connected to one a first end of the second footrest;

a second end of the first Z-shaped linkage rod is rotatably connected to a middle of the third extension link rod;

a second end of the second footrest is provided with a second mounting hole;

a first end of the second Z-shaped linkage rod is rotatably connected to the middle of the third extension link rod;

a second end of the second Z-shaped linkage rod is rotatably connected to a first end of the small footrest;

a middle of the small footrest is rotatably connected to a middle of the second extension link rod;

a second end of the small footrest is provided with a third mounting hole;

the middle of the second extension link rod is further provided with a protruding limit part, and the protruding limit part abuts against a middle of the second Z-shaped linkage rod;

the back structure comprises a backrest member;

the backrest member is rotatably connected to a second end of the mounting side plate;

a limit assembly is arranged on the base, and the limit assembly is configured to limit a position of the backrest member.

2. The structurally improved manual sofa stretching device according to claim 1, wherein the seat structure further comprises a front support member, a rear support member, a front linkage member, an intermediate linkage member, a rear linkage member, a first connecting rod, a second connecting rod, a third connecting rod and a fourth connecting rod;

a first end of the first connecting rod is rotatably connected to the backrest member;

a second end of the first connecting rod is rotatably connected to a first end of the intermediate linkage member;

a second end of the intermediate linkage member is rotatably connected to a first end of the rear support member;

a second end of the rear support member is rotatably connected to a second end of the base;

a middle of the intermediate linkage member is rotatably connected to a first end of the third connecting rod;

a second end of the third connecting rod is rotatably connected to a middle of the front linkage member;

a first end of the front linkage member is rotatably connected to a first end of the front support member;

a second end of the front support member is rotatably connected to a first end of the base;

a second end of the front linkage member is rotatably connected to a middle of the mounting side plate;

a middle of the rear linkage member is rotatably connected to the middle of the mounting side plate;

a first end of the rear linkage member is rotatably connected to a first end of the second connecting rod;

a second end of the second connecting rod is rotatably connected to a middle of the front support member;

a second end of the rear linkage member is rotatably connected to a first end of the fourth connecting rod; and a second end of the fourth connecting rod is rotatably connected to a middle of the fourth foot rod.

3. The structurally improved manual sofa stretching device according to claim 1, wherein the limit assembly comprises a limit bushing;

the second end of the mounting side plate is provided with a guide slot;

the limit bushing is connected to the backrest member through a rotating shaft, and the limit bushing abuts against a side of the guide slot.

4. The structurally improved manual sofa stretching device according to claim 2, wherein the front linkage member is crescent-shaped, and the middle of the front linkage member is provided with a riveting hole and a spare hole.

5. The structurally improved manual sofa stretching device according to claim 2, wherein a first spring is further connected between the third connecting rod and the base through a first mounting assembly, and the first spring is configured to assist in unfolding the leg structure;

the first mounting assembly comprises a first spring peg and a second spring peg;

a middle of the third connecting rod is provided with a first positioning hole;

the first end of the base is provided with a second positioning hole;

a first end of the first spring peg is inserted into the first positioning hole, and a second end of the first spring peg is connected to a first end of the first spring; and a first end of the second spring peg is inserted into the second positioning hole, and a second end of the second spring peg is connected to a second end of the first spring.

6. The structurally improved manual sofa stretching device according to claim 2, wherein a second spring is further connected between the intermediate linkage member and the base through a second mounting assembly, and the second spring is configured to assist in retracting the back structure;

the second mounting assembly comprises a third spring peg;

the first end of the intermediate linkage member is provided with a third positioning hole;

the middle of the mounting side plate is provided with a fourth positioning hole, and the fourth positioning hole is strip-shaped;

a first end of the third spring peg is inserted into the third positioning hole;

a second end of the third spring peg is connected to a first end of the second spring; and a second end of the second spring is hooked in the fourth positioning hole.

7. The structurally improved manual sofa stretching device according to claim 3, wherein an end of the guide slot is provided with an arc-shaped transition portion.

8. The structurally improved manual sofa stretching device according to claim 3, wherein the limit bushing is made of metal.

9. The structurally improved manual sofa stretching device according to claim 3, wherein the limit bushing is made of stainless steel.

* * * * *